United States Patent [19]

Matolcsy

[11] Patent Number: 4,464,224

[45] Date of Patent: Aug. 7, 1984

[54] PROCESS FOR MANUFACTURE OF HIGH BULK PAPER

[75] Inventor: Geza A. Matolcsy, Oakville, Canada

[73] Assignee: CIP Inc., Montreal, Canada

[21] Appl. No.: 393,721

[22] Filed: Jun. 30, 1982

[51] Int. Cl.[3] ..... D21H 5/24

[52] U.S. Cl. ..... 162/111; 162/100; 162/123; 162/141; 162/142

[58] Field of Search ..... 162/100, 141, 111, 201, 162/183, 182, 123, 142

[56] References Cited

U.S. PATENT DOCUMENTS

| | | | |
|---|---|---|---|
| 1,980,881 | 11/1934 | Schur | 162/201 |
| 2,706,155 | 4/1955 | Yundt | 162/141 |
| 3,017,317 | 1/1962 | Voigtman et al. | 162/111 |
| 3,301,746 | 1/1967 | Sanford et al. | 162/113 |
| 3,455,778 | 7/1969 | Bernardin | 162/113 |
| 3,676,294 | 7/1972 | Opderbeck et al. | 162/192 |
| 3,716,449 | 2/1973 | Gatward et al. | 162/101 |
| 3,812,000 | 5/1974 | Salvucci et al. | 162/111 |
| 3,819,470 | 6/1974 | Shaw et al. | 162/157 C |
| 3,821,068 | 6/1974 | Shaw | 162/111 |
| 3,837,999 | 9/1974 | Chung | 162/101 |
| 3,839,144 | 10/1974 | Louden | 162/141 |
| 3,994,771 | 11/1976 | Morgan et al. | 162/113 |
| 3,998,690 | 12/1976 | Lyness et al. | 162/141 |
| 4,046,622 | 9/1977 | Attwood et al. | 162/132 |
| 4,113,936 | 9/1978 | Lesas | 536/56 |
| 4,120,747 | 10/1978 | Sarge et al. | 162/117 |
| 4,204,054 | 5/1980 | Lesas et al. | 536/56 |
| 4,309,246 | 1/1982 | Hulit | 162/113 |
| 4,344,818 | 8/1982 | Nuttall et al. | 162/111 |

FOREIGN PATENT DOCUMENTS

| | | | |
|---|---|---|---|
| 978465 | 11/1975 | Canada . | |
| 1048324 | 2/1979 | Canada . | |
| 1074602 | 4/1980 | Canada . | |
| 1397308 | 6/1979 | United Kingdom | 162/141 |

OTHER PUBLICATIONS

Nelson, "Energy Saving in the Press Section", pp. 30–33, PIMA (Feb. 1981).

*Primary Examiner*—Peter Chin

*Attorney, Agent, or Firm*—Burns, Doane, Swecker & Mathis

[57] ABSTRACT

A process and apparatus for the manufacture of high bulk paper, or a high bulk layer of a multi-layered paper, which uses a mixture of fully hydrated paper making fibres and substantially unhydrated fibres. The unhydrated fibres may be mixed with the conventional slurry of hydrated fibres shortly before the head box. The web may be dried primarily by pressing, with the unhydrated fibres remaining relatively unhydrated throughout the process and ensuring a bulky product; through-driers need not be used. The invention also covers the novel product of this process.

15 Claims, 4 Drawing Figures

PROCESS FOR MANUFACTURE OF HIGH BULK PAPER

BACKGROUND OF THE INVENTION

At this time high bulk paper is produced commercially using through-air drying processes developed more than a decade ago. One of the first patents on this subject was that of Sanford et al (U.S. Pat. No. 3,301,746 issued Jan. 31, 1967 and assigned to The Procter and Gamble Co.), and this was followed by several patents, among them that of Shaw (U.S. Pat. No. 3,821,068 issued June 28, 1974 and assigned to Scott Paper Company).

Through-air drying produces high bulk ligno-cellulosic fibre webs by avoiding the application of compressive forces to the formed paper web on the forming wire or in the press-section until such time as the paper is essentially dry, at which stage the compressive forces used for sheet-transferring and pressing can be applied without substantial loss of bulk. The web is then further dried on a conventional Yankee dryer creped.

In general, through-air drying gives a relatively low-strength sheet, and the various commercial processes differ mainly in the methods used to strengthen the product. Some claim to rely on natural interfibre bonding forces for strength, while others use selective densification or an adhesive bonding system.

Other processes claimed for production of high bulk paper are as follows:

Gatward et al (U.S. Pat. No. 3,716,449 issued Feb. 13, 1973 and assigned to Wiggins Teape Research and Development) form paper webs from a thixotropic foam; and Lesas et al (U.S. Pat. No. 4,204,054 issued May 20, 1980 and assigned to Beghin-Say) use chemically modified fibres to attain the desired high bulk paper products.

The major objective of all of the above processes is to produce a soft, bulky, highly absorbent paper for the manufacture of sanitary tissue products.

The term "high bulk paper" generally means a creped paper having a density between 0.10 and 0.17 g/cm$^3$, based on thickness measured by a caliper gauge at 42.2 g/cm$^2$ pressure with an anvil area of 6.45 cm$^2$.

In spite of claims to the contrary, for a given basis weight, the unit tensile strength of most high bulk tissues is lower than that of conventional tissues. Nevertheless, the important features of high bulk, softness and good absorbency are attained, and consumer acceptance is excellent. In addition, manufacturing economies are achieved because, due to the high bulk (low density) of the sheet, a given area of tissue (and a given volume or roll diameter of tissues) can be created from fewer tonnes of raw material (fibres).

A severe drawback of the presently used commercial processes for production of high bulk paper which use through-air drying is the excessive amount of energy required to achieve water removal by hot-air drying compared with conventional press removal of water. The invention described herein has the advantage of producing high bulk, soft and absorbent paper products without the expenditure of large amounts of energy to remove the moisture from the web.

The invention makes use of the fundamental nature or behavior of ligno-cellulosic fibres. Ligno-cellulosic fibres are stiff, elastic, and springy in the dry or substantially dry condition (say 70–100% solids), and quite the opposite in the fully wetted hydrated state (say 35 to 45% solids). The hydration of papermaking fibres is the very base of conventional papermaking, involving wetting of the cell walls to make them pliable and conformable so as to be able to create the interfibre or papermaking hydrogen bond. The processes of pulping and wet refining are generally the steps used to hydrate the fibres and render them suitable for formation of interfibre bonds. After these steps, the compressive forces of presses act upon the papermaking fibres to remove the water from the paper web and bring the fibre into close proximity to each other. The fibres then remain in this position until papermaking hydrogen bonds are formed by the so-called Campbell forces of the receding meniscus of the water layer between adjacent fibres. In this specification the term "dry fibres" will be used to describe fibres having more than 70% solids, and the term "hydrated" will be used for ligno-cellulosic fibres which have been sufficiently wetted to become papermaking bond forming fibres. The figures for solids content used herein refers to the solids content of the fibre walls.

As stated above, in the dry or substantially dry condition, ligno-cellulosic fibres are stiff, elastic and springy, and when compressed only partially conform to each other. As soon as pressure is released they partially regain their original shape and break their proximity from nearby fibres. Under these conditions the papermaking bond cannot be effectively formed by the above described Campbell forces. This is the essence of the through-air drying prior art by which the fibre web can be compressed without loss of bulk only after sufficient dryness has been attained via through-air drying.

An objective of this invention is to reduce the cost of manufacturing high bulk tissues as compared to processes using through-air drying by using conventional pressing for major water removal.

Another objective of this process is to avoid the introduction of any potentially harmful chemicals into the paper, by using natural unmodified ligno-cellulosic fibres.

Another objective is to avoid the use of specially designed paper machines e.g., based on through-air drying or foam forming.

The invention allows a range of tissue products to be produced having qualities of high bulk, softness and absorbency similar to those of high bulk tissue, and having sufficient strength for converting and consumer use.

SUMMARY OF THE INVENTION

The present invention provides a process for forming high bulk paper characterized by the use of some fibres which are in a papermaking bond forming state, e.g. fibres having interfibre bond forming capacity such as ligno-cellulosic fibres hydrated in the normal fashion, and some which are dry fibres in defibered state (so-called fluff) introduced just prior to formation of the web. The latter fibres are prepared, for example, from dry pulp by dry defibration methods described below; this contrasts with the normal wet defibration methods used in papermaking. The dry fibres are of the type which have interfibre bonding capacity when fully wetted, such as for example chemically unmodified ligno-cellulosic fibres, but the web incorporates a proportion of such initially dry fibres which remain incompletely wetted during pressing and drying of the web by reason of their short contact time with water. In this way the web contains a portion of the fibres in the normal conformable bond forming state and a portion in a drier, more elastic, springy state. Water is removed by conventional pressing followed by conventional drying and creping on the Yankee dryer. During the pressing and drying, only a fraction of the fibres are capable of conforming to produce interfibre papermaking bonds, so that the resulting paper remains low in density with good softness and absorbency. The density of such paper will be between 0.06 and 0.20 g/cm$^3$, measured by a caliper gauge at 42.2 g/cm$^2$ pressure with an anvil area of 6.45 cm$^2$.

The introduction of dry fibres to the furnish just prior to formation of the web eliminates the necessity of drying all fibres in the so-called falling rate drying zone where drying is least efficient and slowest.

For operation in accordance with the invention, conventional cylinder, Fourdrinier or twin-wire machines can be modified by simply adding a fluff (dry fibre) producing unit and a dry fibre delivery and metering unit. These paper machines may have single channel headboxes, or multiple channel headboxes designed to produce multi-layered paper. In the case of a two-channel machine the fluff producing unit may be used in conjunction with only one channel to improve softness and absorbency on the side of the paper which will be on the outside of a converted multi-ply tissue product (2,3 or more plies); and in the case of a three-channel headbox, the two channels which produce the surface layers of the sheet may be the ones receiving fluff. The process can thus be applied equally to produce a high bulk paper or a high bulk layer of a multi-layered paper. The dry fibre delivery system delivers fibres to a suitable place on the paper machine close to the head box. A preferred place is the suction inlet to the fan pump. Alternatively, the dry fibres may be slurried with water and immediately metered into the suction inlet of the fan pump.

The dry fibre or so-called fluff may be produced in accordance with well developed methods of dry defibration, for example as used to produce fluff for such articles as diapers, sanitary napkins and underpads, in which ligno-cellulosic fluff is used as the absorbent medium. Fluff is also used in dry formed papers and non-wovens. Generally, one can form the best quality fluff from low density softwood pulps in rolls. The low density allows low energy defibration without lumps, the softwood provides good fibre length, and the roll form allows one to meter the pulp at a constant rate to the defibrating equipment.

The defibrating equipment can be a star wheel crusher followed by double-disk refiners or hammer mills. A fine-toothed picker roll travelling over a pulp can also generate good quality fluff. Fluff can also be made by solvent exchange drying or freeze-drying of wet pulp. Fluff production is a proven technology well understood by those skilled in the art.

The quality criterion for fluff to be used in this process is that the pulp should be essentially completely defibred without significant loss of fibre length.

The fluff should be delivered at a fairly constant rate, and the amount of dry fibres to be delivered is from 10–80% of the furnish, but typically and desirably is in the narrower range of 25–50% of the furnish. In the case of a multilayered paper, these percentages refer to the individual layer. In the case of a two-channel machine, advantages in accordance with the invention may be obtained where 10% of dry fibres are supplied to one channel of the headbox, i.e., where as little as 5% of the fibres are delivered dry.

Softwood kraft fibres are most suitable as the dry fibres, but hardwood kraft and sulphite hardwood and softwood fibres or mechanical pulps are also suitable. Any ligno-cellulosic fibrous papermaking material from any plant such as cotton, sisal, reed, bamboo, sugar cane and straw, etc., is also suitable for use in the process.

The point of introduction of the dry fibre material alone or freshly slurried with water into the system is not necessarily at the fan pump inlet; it can be earlier or later in the process. The critical parameter is that the web should incorporate fibres which are initially dry (at least 70% solids) and which remain incompletely wetted, having for example at least 50% solids during formation and pressing of the web. The point of introduction of the dry fibres may also be such that the web incorporates incompletely wetted fibres which retain a solids content at least 25% greater than that of the bond forming fibres while the web is formed and pressed by virtue of the short length of time they are in contact with water. For example, if the bond forming fibres are hydrated fibres having a solids content of 40% then the web will incorporate initially dry fibres having a solids content of at least 50%. The wetting process depends not only on time but also on the temperature of the water and severity of agitation and the type of fibre. However, with other conditions being equal, the shorter the time the better the results. Typically a maximum fibre-water contact time at 38° C. and mild agitation is ½ hour, but usually a much shorter time e.g., 10 minutes or less will be used. During this time and beyond this time, progressive reduction of bulk occurs in the fibrous web.

BRIEF DESCRIPTION OF THE DRAWINGS

The invention will now be described by way of example with reference to the accompanying drawings, in which.

DETAILED DESCRIPTION

Figure 1:
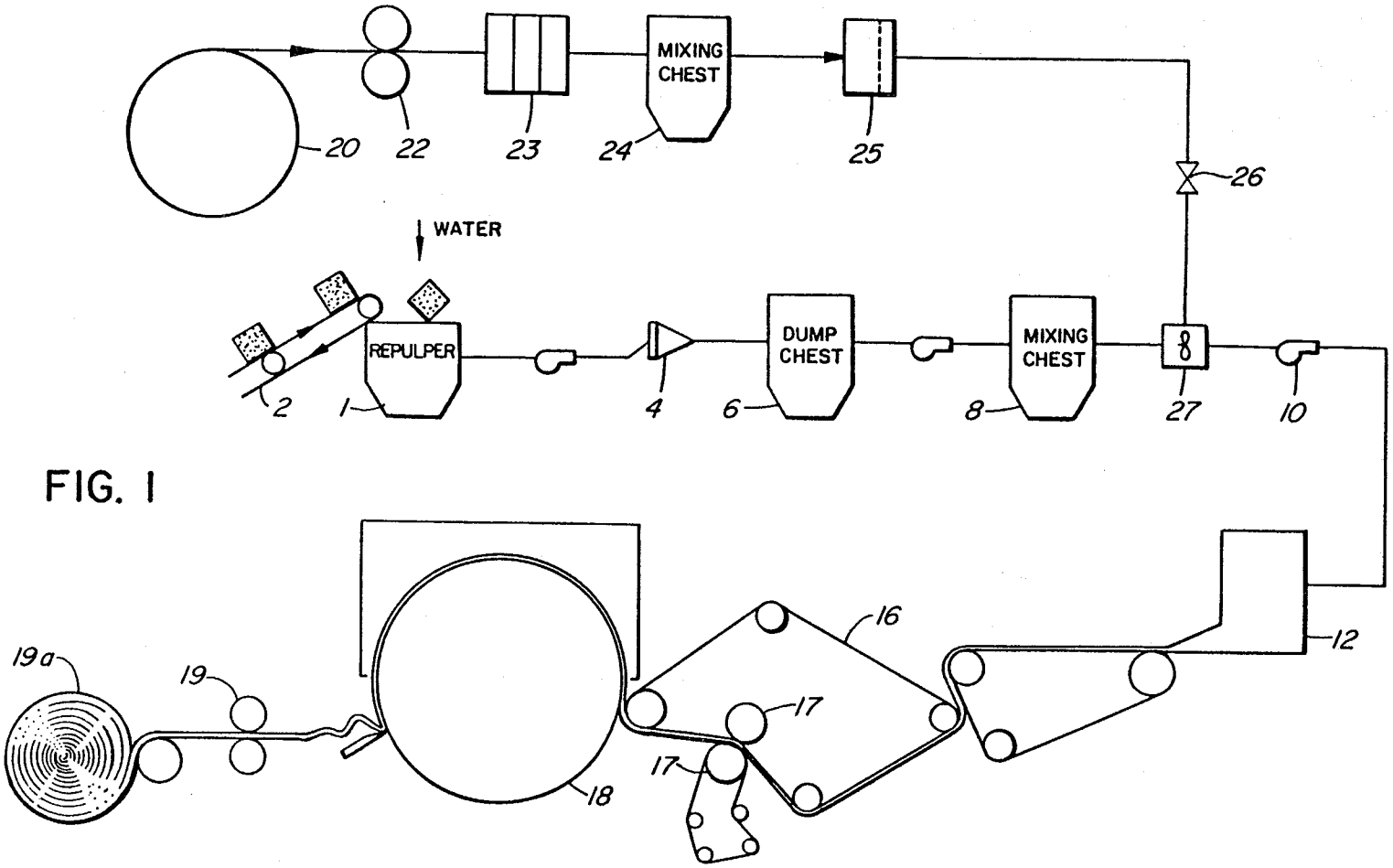
FIG. 1 shows a schematic view of a Fourdrinier type papermaking machine for making high bulk paper in accordance with the invention.

The system shown in FIG. 1 has major components which are the same as in a conventional tissue making machine of the Fourdrinier type. These include a repulper 1 which receives the pulp from a conveyor 2, a refiner 4 connected between the repulper 1 and a dump chest 6, a mixing chest 8 receiving the mixture from the dump chest for proportioning and dilution of this mixture, and a fan pump 10 moving the mixed and diluted pulp from chest 8 to head box 12. The head box feeds the pulp mixture onto wire 14 from which the partially formed web is transferred to a felt 16, the web then passing between press rolls 17 and onto the Yankee dryer 18 from which it is creped. The creped paper passes between calender rolls 19 and is wound onto reel 19*a*. Conventional broke recovery and water recycling equipment may be used but these have been omitted from the drawing for simplicity.

On a conventional paper machine having the components described, there is 2 hours delay between the initial wetting of the pulp, and drying of the paper on the Yankee dryer 18. During all of this time the lignocellulosic fibres are worked in water or are at least in contact with water, so that water penetrates the fibre walls and gives the fibres their plasticity and conformability to each other for bonding.

Due to the very high speed of conventional tissue machines, the time elapsed between the fan pump 10 and the Yankee dryer 18 is only a matter of seconds. For example, at 3000 ft/min (914 meters/min) machine speed and with a 60 ft. (18.3 meter) stock distribution system, a 60 ft. wire section, a 60 ft. press section and a 20 ft. (6.1 meter) diameter Yankee cylinder, the total time to the doctor blade is 4.8 second from the fan pump. With higher speeds or shorter sections the time is proportionally less. Thus, if one introduces dry fibres into the machine in the vicinity of the suction inlet of the fan pump, the web will incorporate initially dry fibres which have only been in contact with water for five seconds or so. This time is sufficiently short to curtail the wetting of the lignocellulosic fibres.

In the preferred mode of the present invention, dry fibres are slurried with water and introduced into the process stream of fibre/air/water mixture in the vicinity of the head box 12 via the fan pump 10, and form the sheet of paper from a mixture of hydrated and incompletely wetted ligno-cellulosic fibres.

All other operations are conventional, i.e., stock dispersion, delivery, and water removal by the wire section and press section. Yankee drying and creping are modified in a manner to be described later.

FIG. 1 shows a suitable system for delivery of dry fibres (fluff) to the head box 12 via the suction inlet of the fan pump 10. The system includes an unwind station 20 for a cylindrical roll of dry pulp, a crusher 22, a disc refiner 23, a mixing chest 24 in which the dry fibres are slurried with water, a high pressure screen 25 for removal of lumps or nits from the slurry, a flow meter 26, and an inline mixer 27 placed in the main slurry conduit just before the fan pump 10.

Once the mixture of fibres has passed through the head box and is on the wire, all other processes are conventional, i.e., water drainage, sheet transfer, and pressing by rolls 17. The system does not require any through-air dryers commonly used in making high bulk tissue. While through-air dryers may, if desired, remove some of the water, normally the major amount of water will be removed by pressing. Final drying and creping are done on a conventional Yankee dryer, but it is found that drying and creping efficiency are relatively poor unless a creping aid is used. Accostrength 85*, Accostrength 86*, Elvanol 70-30*, Creptrol 272*, Houghton 560*, animal glue, starch, and a range of wet strength resins all work well, depending on the circumstances of fibre furnish and water system.

*Trade Marks

It is further noted, that, as is expected with low density, high bulk ligno-cellulosic sheets, the fibre bonding intensity is low and so the strength is low. It is anticipated that, on commercial production, strength additives may be used either by wet addition to the stock system or by spraying, padding, immersion saturation, coating or printing onto the already formed web prior to the Yankee dryer or onto the Yankee dryer surface.

The following are examples of experiments made using the process of this invention.

EXAMPLE I

"Supersoft"* bleached softwood kraft pulp was defibred on the hammer mill by the known usual techniques. The fluff so formed was wound into weighed units.

*Trade Marks

A cylinder paper machine producing specialty grades of tissue was used for the pilot plant trial. The machine was running at 200 ft/min (70 meters/min) on the wet-felt, 160 ft/min (49 meters/min) at the reel, and 190 ft/min (58 meters/min) at the Yankee. The machine is 126" (3.2 meters) wide.

The wet stock composition was 80% softwood bleached kraft and 20% hardwood bleached kraft. The stock was unrefined, and 5 lb/ton sodium tripolyphosphate were added to the stock.

The defibred dry fluff was added into the mixing chest 8 (consistency 0.3%) via a specially designed water-fibre slurrying and dilution apparatus located on a platform above the mixing chest. The fibres were manually fed at a rate of 3.33 lb/min (1.52 kg/min) into the slurrying and dilution apparatus which had 30 gal/min (136 liters/min) white water flowing into it through three nozzles for dilution. The slurrying and dilution apparatus contained a spout to allow the "dry-fibre" water slurry to fall into the mixing chest. The mixing chest had a propeller high-speed mixer in the vicinity where the "dry-fibre" water slurry hit the conventional stock. This mixer was used to defibre improperly separated "dry" fibre nits and lumps.

During the experiment the amount of dry fibres specified was 30% by weight of the total production. During the 50 minutes production run, the average dry fibre content was 25% by weight of the furnish, but during the first few minutes of the trial it was nearly zero % and at the end of the trial, 40%. The average residence time of dry fibres in the slurrying and dilution apparatus, mixing chest, head box, and fan pump system was as high as 24 minutes. In spite of this relatively long residence time, excellent results of bulk, absorbency and softness were achieved.

Before the experiment, control tissues were made with no dry fibre addition and sampled every 5 minutes at the reel for physical testing.

At about thirteen minutes from the start of testing, after two control tissues had been sampled, dry fibres were fed into the mixing chest by the above described method at the rate of 3.33 lb/min (1.52 kg/min), and samples of the paper were taken at regular intervals for the testing of tissue quality. At the end of dry-fibre addition, 59 minutes from the start of testing, another set of control tissues was made and tested. Samples taken at between 42 and 59 minutes from the start of testing represent tissues with suitable mixtures of bond forming and incompletely wetted fibres in accordance with the invention.

The sample tissues were tested by conventional means for basis weight, caliper, machine and cross machine tensile strength, stretch, and absorbency rate and capacity. The results are summarized in Table 1 and FIGS. 2, 3 and 4.

The general observation from the standpoint of runnability on the machine was that the mixture of dry and wet fibres behaved the same way on the Yankee cylinder as the through-air dried tissues or those produced according to U.S. Pat. No. 4,204,054. There was some difficulty with dryer adhesion and creping, and also the finished sheet contained some nits or lumps but these problems related to the preliminary nature of the equipment. This is the reason a high pressure screen for nit removal, and a creping aid for dryer adhesion, are desirable features of the apparatus and process.

Figure 2:
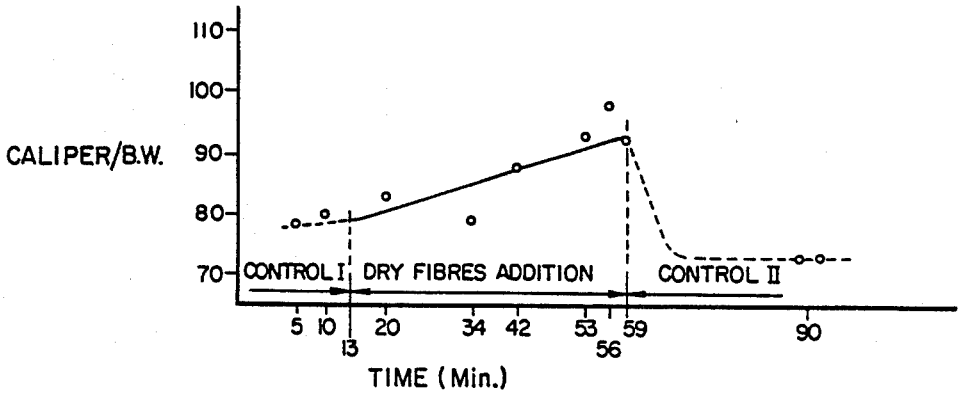
FIGS. 2, 3 and 4 are graphs showing the physical properties of samples taken at intervals as described in Example 1 below.

FIG. 2 depicts the changes in relative bulk during the period of the trial. As can be clearly seen, the thickness per unit weight of fibres increased considerably during the trial.

Figure 3:
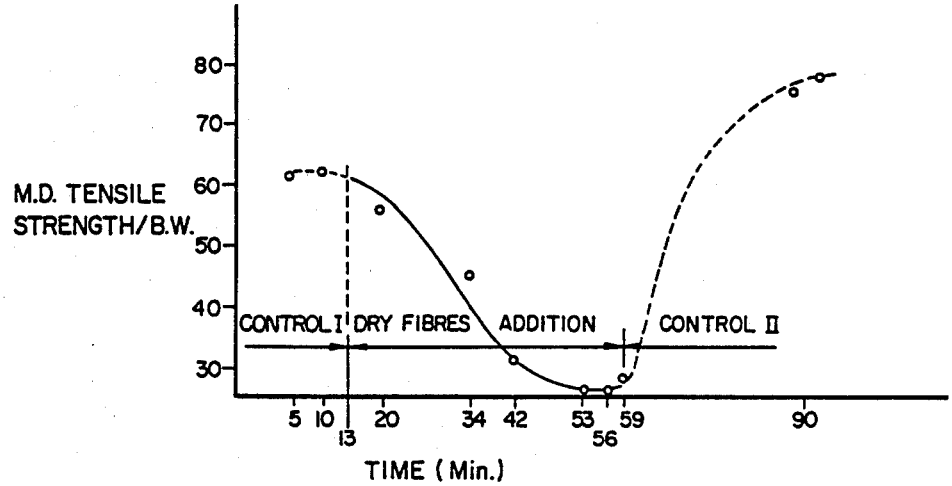

FIG. 3 depicts the change of machine direction tensile strength. Considerable tensile strength reduction occurred. This is characteristic of high bulk tissue products. In order to control tensile strength, the use of additives may be necessary in this process.

Figure 4:
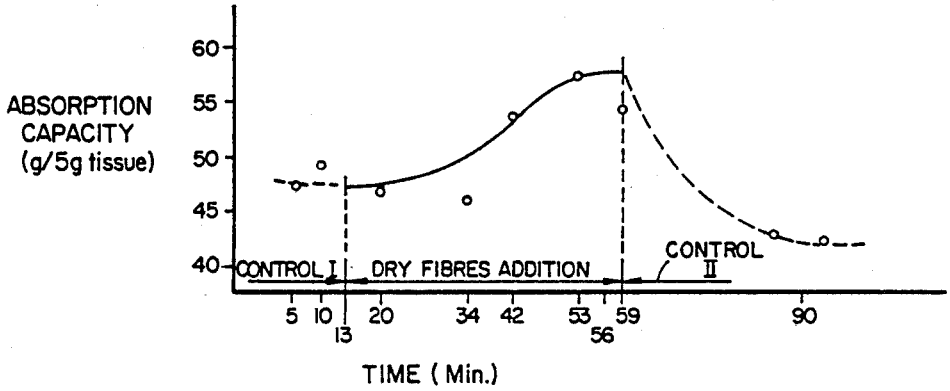

FIG. 4 depicts the increase in water absorbency capacity per unit weight of tissues during the trial. The beneficial change in absorbency characteristics is the increase of water-holding ability as clearly shown.

This trial confirmed that the properties of sanitary tissues can be dramatically changed by addition of dry fibres, even if the contact time with water is allowed to be as high as 24 minutes. The properties of the tissues approach to those of high bulk tissues produced by through-air drying, or by the process as described in U.S. Pat. No. 4,204,054.

TABLE 1

| SAMPLE TIME Hr. Min. | B.W.xxxx Oven Dry ($g/m^2$) | Caliperxxxxx ($\mu$/16 ply) | Caliper B.W. | Increase in Caliper B.W. over the control (%) | Tensile Strength* (g/76 mm) M.D.+ | Tensile Strength* (g/76 mm) C.D.++ | M.D. Stretch (%) | Tensile Strength/B.W. M.D.+ | Tensile Strength/B.W. C.D.++ | Absorbency** Rate (sec/5 g) | Absorbency** Capacity (g/5 g) | Comments |
|---|---|---|---|---|---|---|---|---|---|---|---|---|
| 13.05 | 17.5 | 1365 | 78.0 | | 1083 | 249 | 15.5 | 62 | 4 | 3.5 | 47.8 | Control I |
| 13.10 | 17.3 | 1380 | 79.8 | | 1094 | 271 | 16.2 | 63 | 16 | 3.5 | 50.2 | No dry fibres |
| 13.20*** | 19.2 | 1610 | 83.9 | 3 | 1079 | 259 | 16.9 | 56 | 13 | 4.0 | 47.3 | Less than equilibrium |
| 13.34 | 22.2 | 1765 | 79.5 | 8 | 1014 | 278 | 16.5 | 45 | 12 | 4.0 | 47.5 | concentration of dry fibres in the initial period |
| 13.42 | 18.3 | 1670 | 91.3 | 16 | 364 | 168 | 15.5 | 31 | 9 | 3.6 | 54.5 | Experimental tissue |
| 13.53 | 19.2 | 1800 | 93.8 | 17 | 495 | 159 | 14.2 | 26 | 8 | 2.5 | 57.8 | |
| 13.56 | 18.0 | 1755 | 97.5 | 21 | 469 | 158 | 14.3 | 26 | 9 | 2.1 | 66.2 | |
| 13.59 | 19.2 | 1790 | 93.2 | 16 | 550 | 179 | 14.4 | 28 | 9 | 2.0 | 55.2 | |
| About 14.30 | 20.9 | 1560 | 74.6 | | 1616 | 329 | 17.5 | 77 | 16 | 3.8 | 47.4 | Control II No dry fibres |
| | 20.9 | 1570 | 75.1 | | 1654 | 326 | 16.6 | 79 | 16 | 3.5 | 47.7 | |

*Calculated Relative to the Average Value of the Four Control Samples
**Sinking Basket Test
***Dry Fibre Addition Initiated at 13.13
*****Caliper was tested with the Ames caliper tester at anvil area 6.45 $cm^2$ and compression 42.2 $gm/cm^2$.
xxxxB.W. = Basis Weight
+M.D. = Machine Direction
++C.D. = Cross Direction

EXAMPLE II

A softwood bleached kraft pulp (Cellate)* was soaked for 4 hours in tap water, disintegrated in the British* disintegrator for 15 minutes at 1.5% consistency, and then diluted to 0.3% consistency for handsheet making.

A commercially available fluff sample made from bleached southern pine kraft was slurried for 10 seconds in the Waring Blender* with tap water at 0.3% consistency, just prior to introduction into the handsheet mold. Handsheets were made from 100% Cellate*, 80% Cellate*+20% fluff, 75% Cellate*+25% fluff, and 50% Cellate*+50% fluff. During the regular handsheet making, two pressing cycles were used, one for 5 minutes, followed by one for 2 minutes. Handsheets were made with (1) no pressing, (2) one two minute pressing cycle or (3) full pressing with both cycles as shown in Table 2, for the various combination of Cellate* and fluff. There were two sets of handsheets made; one set at 60 $g/m^2$ basis weight for thickness and tensile measurements and one set of 20 $g/m^2$ basis weight for softness tests. Thickness and tensile breaking lengths were measured on the various sheets. The results are given in Table 2. The results in Table 2 indicate that with no pressing, there was an increase of 33% in bulk and a 57% reduction in tensile strength when 50% dry fibres were used compared to using 100% of the completely wetted fibres. For 20% dry fibre addition, the bulk increase was 18% and the tensile drop 30%. For 25% dry fibre addition, the bulk increased 17.8% and the tensile strength dropped by 46.4%.

*Trade Marks

Using the full pressing cycle, the 50% dry fibre addition improved bulk by 18.8–19.8% and reduced tensile strength by 58.7 to 62.5%. Softness of the light weight handsheets with dry fluff was at least twice as good as that of the control sheets with 100% completely wetted fibres.

TABLE 2

| Composition Cellate | Composition Dry Fibre | Processing Steps | Bulk $cm^3/g$ | Breaking Length m | Percent Change Tensile | Percent Change Bulk |
|---|---|---|---|---|---|---|
| 100 | — | No pressing* | 3.51 | 1893 | 0 | 0 |
| 80 | 20 | No pressing* | 4.15 | 1322 | 30.2 | 18 |
| 50 | 50 | No pressing* | 4.66 | 804 | 57.5 | 33 |
| 100 | — | Regular pressing | 1.81 | 3557 | 0 | 0 |
| 50 | 50 | Regular pressing | 2.15 | 1469 | 58.7 | 18.8 |
| 50 | 50 | 1 Pressing | 2.66 | 1079 | 62.5 | 19.8 |
| 100 | — | 1 Pressing | 2.22 | 2876 | 0 | 0 |
| 75 | 25 | No Pressing | 4.43 | 960 | 46.8 | 17.8 |
| 100 | — | No Pressing | 3.76 | 1805 | 0 | 0 |

Physical Properties of Handsheets Made With Dry Fluff

*Photographic Dryer used

EXAMPLE III

In the previous two examples, the beneficial effects of dry fibre addition were demonstrated both using full mill scale equipment and in the laboratory, in relation to the bulk, softness and absorbency of paper. The previous laboratory experiments dealt with the effect of dry fibre addition rate (20–50%) and pressing conditions (0-full pressing) in the handsheet machine.

In this example the effect of two different types of commercial pulps and the effect of four soaking time intervals on the bulk-tensile relationship were studied. The percentage of dry fibres, and pressing conditions were held constant. The dry fibres were added to two different stocks: one refined, the other unrefined.

The materials were (1) Supersoft* fully bleached southern pine kraft pulp fluff made by double disk refiner, (2) Gatineau SCMP* pulp fluff made by the hammer mill, (3) Cellate* fully bleached northern kraft pulp unbeaten, and beaten for 1000 revolutions in the PFI mill to a Canadian Standard Freeness of 520. The dry fibre addition rate was 30% and the time of soaking 0, 5, 15 and 30 minutes. Because the mixing and handsheet making operations took about 8.4 minutes, even the 0 minute soaking had the fibres in contact with water for this length of time. Table 3 summarizes the results.

Gatineau SCMP* pulp fluff increased bulk better than Supersoft* pulp fluff. There was less change using unrefined pulp than using refined pulp for both fluffs. Soaking time in the 0–30 minute range did not affect bulk or strength measurably. Typically the unrefined Cellate* increased in bulk by ~12% with 30% Supersoft* fluff addition, and increased in bulk by ~24% on 30% Gatineau SCMP* fluff addition. The corresponding strength decreases were ~17% and ~20%, respectively. For the refined Cellate*, Supersoft* fluff increased bulk by ~21%, and the same amount of Gatineau SCMP* fluff increased bulk by ~33%. The corresponding strength drops were ~30 and ~35%, respectively. No softness or absorbency measurements were made, but subjective feel of the handsheets confirmed our earlier measurements on the softness rating of sheets made with dry fibres.

*Trade Marks

TABLE 3

| | Physical Properties of Handsheets | | | | | | | |
|---|---|---|---|---|---|---|---|---|
| | Unrefined Samples | | | | Refined Samples | | | |
| | Bulk Factor | | Breaking Length | | Bulk Factor | | Breaking Length | |
| | $cm^3/g$ | % Change | m | % Change | $cm^3/g$ | % Change | m | % Change |
| Cellate* | 3.51 | 0 | 1730 | 0 | 2.94 | 0 | 4740 | 0 |
| Supersoft* 0 min. | 3.84 | 9.4 | 1438 | 16.9 | 3.57 | 21.2 | 3541 | 25.3 |
| 5 min. | 3.80 | 8.3 | 1388 | 19.8 | 3.58 | 21.7 | 3276 | 30.9 |
| 15 min. | 3.95 | 12.5 | 1361 | 21.3 | 3.57 | 21.4 | 3215 | 32.2 |
| 30 min. | 4.04 | 15.1 | 1484 | 14.2 | 3.48 | 18.2 | 3266 | 31.1 |
| Gatineau* 0 min. | 4.40 | 25.4 | 1335 | 22.8 | 3.94 | 34.0 | 3059 | 35.5 |
| 5 min. | 4.35 | 23.9 | 1398 | 19.2 | 3.85 | 31.0 | 3079 | 35.0 |
| 15 min. | 4.39 | 25.1 | 1432 | 17.2 | 3.92 | 33.3 | 3219 | 32.1 |
| 30 min. | 4.37 | 24.5 | 1359 | 21.4 | 3.90 | 32.5 | 3077 | 35.1 |

*Trademark

The embodiments of the invention in which an exclusive property or privilege is claimed are defined as follows:

1. A process for the manufacture of a high bulk paper or a high bulk layer of a multi-layered paper, said paper or layer being creped, in which an aqueous slurry consisting essentially of ligno-cellulosic fibers in a papermaking bond forming state is dewatered in contact with a foraminous surface to form a web which is subsequently pressed and dried, characterized in that dry fibers consisting essentially of ligno-cellulosic fibers of the type which when fully wetted have interfiber bonding capacity are introduced into the slurry and interspersed with said bond forming state fibers shortly before formation of the web and in such manner that the web incorporates initially dry fibers which entered the slurry in said introducing step and which remain incompletely wetted by reason of having a short water contact time of less than 45 minutes while the web is formed and pressed and is creped by being passed over a Yankee cylinder, the amount of said incompletely wetted fibers being between 10% and 80% of the total fibers used to form the web.

2. A process according to claim 1, including the step of subjecting said dry fibers to dry defibration before introduction into the slurry.

3. A process for the manufacture of a high bulk paper or a high bulk layer of a multi-layered paper said paper or layer being creped, which process comprises the steps of:

(a) forming an aqueous slurry consisting essentially of ligno-cellulosic fibers in a papermaking bond forming state, (b) subjecting dry pulp consisting essentially of ligno-cellulosic pulp to dry defibration and introducing the dry fibers so produced into said slurry and mixing these with the bond forming state fibers, said dry fibers consisting essentially of the type which when fully wetted have interfiber bond forming capacity; and shortly thereafter, (c) dewatering the slurry of mixed fibers in contact with a foraminous surface to form a web which is subsequently pressed, dried and creped by being passed over a Yankee cylinder, and wherein the web incorporates fibers produced by said dry defibration step which remain incompletely wetted during forming, pressing and drying of the web by reason of their having a short contact time with water which is less than 45 minutes, the amount of said incompletely wetted fibers being between 10% and 80% of the total fibers used to form the web.

4. A process according to claim 1 or claim 3 wherein said dry fibers are mixed with water shortly prior to being introduced into the slurry.

5. A process according to any of claims 1, 2 or 3, wherein said short contact time is less than 30 minutes.

6. A process according to any of claims 1, 2 or 3, wherein said short contact time is less than 10 minutes.

7. A process according to any of claims 1, 2 or 3 wherein the dry fibers are introduced into the slurry of bond forming state fibers in the vicinity of the head box of a papermaking machine.

8. A process according to any of claims 1, 2 or 3 wherein the dry fibers are introduced into the slurry of bond forming state fibers in the vicinity of the suction inlet of the fan pump of a papermaking machine.

9. A process according to any of claims 1, 2 or 3, wherein the amount of dry fibers entering the process is between 25% and 50% of the total fibers used for forming the web.

10. A process according to any of claims 1, 2 or 3, wherein the web incorporates fibers which are initially dry fibers and retain a solids content of at least 50% while the web is formed and pressed.

11. A process according to any of claims 1, 2 or 3, wherein the web incorporates fibers which are initially dry fibers and retain a solids content of at least 70% while the web is formed and pressed.

12. A process according to any of claims 1, 2 or 3, wherein the web incorporates fibers which are initially dry fibers and retain a solids content of at least 25% greater than the solids content of the bond forming state fibers while the web is formed and pressed.

13. A process according to any of claims 1, 2 or 3, wherein after the web is formed the major amount of water is removed by pressing.

14. A process according to any of claims 2, 3, or 4, wherein the dry fibers are subjected to mechanical defibration before introduction into the slurry.

15. A process according to any of claims 1, 2, 3 or 4, wherein said ligno-cellulosic bond forming state fibers have a solids content of less than 45%.

* * * * *

REEXAMINATION CERTIFICATE (863rd)
United States Patent [19]
Matolcsy
[11] B1 4,464,224
[45] Certificate Issued May 31, 1988

[54] PROCESS FOR MANUFACTURE OF HIGH BULK PAPER

[75] Inventor: Geza A. Matolcsy, Oakville, Canada

[73] Assignee: CIP Inc., Montreal, Canada

Reexamination Request:
No. 90/000,999, Apr. 29, 1986

Reexamination Certificate for:
Patent No.: 4,464,224
Issued: Aug. 7, 1984
Appl. No.: 393,721
Filed: Jun. 30, 1982

[51] Int. Cl.[4] ..... D21H 5/24
[52] U.S. Cl. ..... 162/111; 162/100; 162/123; 162/141; 162/142
[58] Field of Search ..... 162/9, 142, 150, 111, 162/113, 182

[56] References Cited

U.S. PATENT DOCUMENTS 1,980,881 11/1934 Schur ..... 162/201
4,036,679 7/1977 Back et al. ..... 162/9

FOREIGN PATENT DOCUMENTS 364565 11/1922 Fed. Rep. of Germany .

OTHER PUBLICATIONS

Battista, *Synthetic Fibers in Papermaking*, Interscience Publishers, (1964), p. 116.
Casey, *Pulp and Paper*, vol. II, 3rd ed., (1980), pp. 937–939.
Casey, *Pulp and Paper*, 3rd ed., vol. III (1981), pp. 1557, 1763, 1764.

*Primary Examiner*—Peter Chin

[57] ABSTRACT

A process and apparatus for the manufacture of high bulk paper, or a high bulk layer of a multi-layered paper, which uses a mixture of fully hydrated paper making fibres and substantially unhydrated fibres. The unhydrated fibres may be mixed with the conventional slurry of hydrated fibres shortly before the head box. The web may be dried primarily by pressing, with the unhydrated fibres remaining relatively unhydrated throughout the process and ensuring a bulky product; through-driers need not be used. The invention also covers the novel product of this process.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 1, lines 15–22:

Through-air drying produces high bulk ligno-cellulosic fibre webs by avoiding the application of compressive forces to the formed paper web on the forming wire or in the press-section until such time as the paper is essentially dry, at which stage the compressive forces used for sheet-transferring and pressing can be applied without substantial loss of bulk. The web is then further dried on a conventional [Yankee] *yankee* dryer *and* creped.

Column 2, line 53 through column 3, line 13:

The present invention provides a process for forming high bulk paper characterized by the use of some fibres which are in a papermaking bond forming state, e.g. fibres having interfibre bond forming capacity such as ligno-cellulosic fibres hydrated in the normal fashion, and some which are dry fibres in defibered state (so-called fluff) introduced just prior to formation of the web. The latter fibres are prepared, for example, from dry pulp by dry defibration methods described below; this contrasts with the normal wet defibration methods used in papermaking. The dry fibres are of the type which have interfibre bonding capacity when fully wetted, such as for example chemically unmodified ligno-cellulosic fibres, but the web incorporates a proportion of such initially dry fibres which remain incompletely wetted during pressing and drying of the web by reason of their short contact time with water. In this way the web contains a portion of the fibres in the normal conformable bond forming state and a portion in a drier, more elastic, springy state. Water is removed by conventional pressing followed by conventional drying and creping on the [Yankee] *yankee* dryer. During the pressing and drying, only a fraction of the fibres are capable of conforming to produce interfibre papermaking bonds, so that the resulting paper remains low in density with good softness and absorbency. The density of such paper will be between 0.06 and 0.20 g/cm$^3$, measured by a caliper gauge at 42.2 g/cm$^2$ pressure with an anvil area of 6.45 cm$^2$.

Column 4, lines 49–65:

The system shown in FIG. 1 has major components which are the same as in a conventional tissue making machine of the Fourdrinier type. These include a repulper 1 which receives the pulp from a conveyor 2, a refiner 4 connected between the repulper 1 and a dump chest 6, a mixing chest 8 receiving the mixture from the dump chest for proportioning and dilution of this mixture, and a fan pump 10 moving the mixed and diluted pulp from chest 8 to head box 12. The head box feeds the pulp mixture onto wire 14 from which the partially formed web is transferred to a felt 16, the web then passing between press rolls 17 and onto the [Yankee] *yankee* dryer 18 from which it is creped. The creped paper passes between calender rolls 19 and is wound onto reel 19a. Conventional broke recovery and water recycling equipment may be used but these have been omitted from the drawing for simplicity.

Column 4, line 66 through column 5, line 5:

On a conventional paper machine having the components described, there is 2 hours delay between the initial wetting of the pulp, and drying of the paper on the [Yankee] *yankee* dryer 18. During all of this time the lignocellulosic fibres are worked in water or are at least in contact with water, so that water penetrates the fibre walls and gives the fibres their plasticity and conformability to each other for bonding.

Column 5, line 6 through column 5, line 20:

Due to the very high speed of conventional tissue machines, the time elapsed between the fan pump 10 and the [Yankee] *yankee* dryer 18 is only a matter of seconds. For example, at 3000 ft/min (914 meters/min) machine speed and with a 60 ft. (18.3 meter) stock distribution system, a 60 ft. wire section, a 60 ft. press section and a 20 ft. (6.1 meter) diameter [Yankee] *yankee* cylinder, the total time to the doctor blade is 4.8 second from the fan pump. With higher speeds or shorter sections the time is proportionally less. Thus, if one introduces dry fibres into the machine in the vicinity of the suction inlet of the fan pump, the web will incorporate initially dry fibres which have only been in contact with water for five seconds or so. This time is sufficiently short to curtail the wetting of the lignocellulosic fibres.

Column 5, line 40 through column 5, line 54:

Once the mixture of fibres has passed through the head box and is on the wire, all other processes are conventional, i.e., water drainage, sheet transfer, and pressing by rolls 17. The system does not require any through-air dryers commonly used in making high bulk tissue. While through-air dryers may, if desired, remove some of the water, normally the major amount of water will be removed by pressing. Final drying and creping are done on a conventional [Yankee] *yankee* dryer, but it is found that drying and creping efficiency are relatively poor unless a creping aid is used. Accostrength 85*, Accostrength 86*, Elvanol 70–30*, Creptrol 272*, Houghton 560*, animal glue, starch, and a range of wet strength resins all work well, depending on the circumstances of fibre furnish and water system.

*Trade Marks

Column 5, line 55 through column 5, line 62:

It is further noted, that, as is expected with low density, high bulk ligno-cellulosic sheets, the fibre bonding intensity is low and so the strength is low. It is anticipated that, on commercial production, strength additives may be used either by wet addition to the stock system or by spraying, padding immersion saturation, coating or printing onto the already formed web prior to the [Yankee] *yankee* dryer or onto the [Yankee] *yankee* dryer surface.

Column 6, line 4 through column 6, line 9:

A cylinder paper machine producing specialty grades of tissue was used for the pilot plant trial. The machine was running at 200 ft/min (70 meters/min) on the wet-felt, 160 ft/min (49 meters/min) at the reel, and 190 ft/min (58 meters/min) at the [Yankee] *yankee*. The machine is 126" (3.2 meters) wide.

Column 6, line 60 through column 7, line 2:

The general observation from the standpoint of runnability on the machine was that the mixture of dry and wet fibers behaved the same way on the [Yankee] *yankee* cylinder as the through-air dried tissues or those produced according to U.S. Pat. No. 4,204,054. There was some difficulty with dryer adhesion and creping, and also the finished sheet contained some nits or lumps but these problems related to the preliminary nature of the equipment. This is the reason a high pressure screen for nit removal, and a creping aid for dryer adhesion, are desirable features of the apparatus and process.

AS A RESULT OF REEXAMINATION, IT HAS BEEN DETERMINED THAT:

Claim 10 is cancelled.

Claims 1 and 3 are determined to be patentable as amended.

Claims 2, 4–9 and 11–15, dependent on an amended claim, are determined to be patentable.

New claims 16–29 are added and determined to be patentable.

1. A process for the manufacture of high bulk *soft tissue* paper or a high bulk *soft tissue* layer of a multi-layered *tissue* paper, said paper or layer being creped *and said paper having a basis weight up to 60 g/m²*, in which an aqueous slurry consisting essentially of ligno-cellulosic fibers *and including such fibers* in a paper-making bond forming state is dewatered in contact with a foraminous surface to form a web which is subsequently pressed and dried, characterized in that dry fibers consisting essentially of ligno-cellulosic fibers of the type which when fully wetted have interfiber bonding capacity are introduced into the slurry and interspersed with said bond forming state fibers shortly before formation of the web and in such manner that the web incorporates initially dry fibers which entered the slurry in said introducing step and which [remain incompletely wetted] *retain a solids content of at least 50%* by reason of having a short water contact time of less than 45 minutes while the web is formed and pressed and is creped by being passed over a [Yankee] *yankee* cylinder, the amount of said [incompletely wetted] *initially dry* fibers being between 10% and 80% of the total fibers used to form the web, *said bond forming state fibers being unrefined or refined only to a level such that the density of the creped web is between 0.06 and 0.20 g/cm³ measured by a caliper gauge at 42.2 g/cm² pressure with an anvil area of 6.45 cm².*

3. A process for the manufacture of a high bulk *soft tissue* paper or a high bulk *soft tissue* layer of a multi-layered *tissue* paper, said *tissue* paper or layer being creped *and said paper having a basis weight up to 60 g/m²*, which process comprises the steps of:

(a) forming an aqueous slurry consisting essentially of ligno-cellulosic fibers *and including such fibers* in a papermaking bond forming state, (b) subjecting dry pulp consisting essentially of ligno-cellulosic pulp to dry defibration and introducing the dry fibers so produced into said slurry and mixing these with the bond forming state fibers, said dry fibers consisting essentially of the type which when fully wetted have interfiber bond forming capacity; and shortly thereafter, (c) dewatering the slurry of mixed fibers in contact with a foraminous surface to form a web which is subsequently pressed, dried and creped by being passed over a [Yankee] *yankee* cylinder, and wherein the web incorporates fibers produced by said dry defibration step which [remain incompletely wetted] *retain a solids content of at least 50%* during forming, pressing and drying of the web by reason of their having a short contact time with water which is less than 45 minutes, the amount of said [incompletely wetted] *dry defibration step* fibers being between 10% and 80% of the total fibers used to form the web, *said bond forming state fibers being unrefined or refined only to a level such that the density of the creped web is between 0.06 and 0.20 g/m³ measured by a caliper gauge at 42.2 g/cm² pressure with an anvil area of 6.45 cm².*

*16. A process according to any of claim 1, 2, 3 or 4 wherein said process is carried out on a twin-wire paper machine.*

*17. A process according to claim 14 wherein said mechanical defibration is performed by hammermilling.*

*18. A process according to claim 4 wherein said dry fiber/water mixture is introduced into the slurry of bond forming state fibers in the vicinity of the headbox of a papermaking machine.*

*19. A process according to any of claims 1, 2, or 3, wherein said dry fibers are mixed with water in a mixing vessel, and the mixture of dry fibers with water formed in this vessel is then pumped to the vicinity of the headbox of a paper-making machine.*

*20. A process according to any one of claims 1, 2, or 3 wherein said aqueous slurry is formed by mixing pulp with water and passing the mixture through a refiner and through several chests where the pulp is dispersed in the water and hydrated to said bond forming state, and wherein said dry fibers are introduced into the slurry after this has passed out of the last of said chests before the slurry reaches the headbox of a papermaking machine.*

*21. A process according to claim 1 or claim 3 wherein the creped web produced has a specific strength of at least* 26 measured as machine direction tensile strength in g/76-mm divided by basis weight in g/m².

*22. A process for the manufacture of a high bulk soft tissue paper or a high bulk soft tissue layer of a multi-layered tissue paper, said paper or layer being creped, in which an aqueous slurry consisting essentially of ligno-cellulosic fibers and including such fibers in a paper-making bond forming state is dewatered in contact with a foraminous surface to form a web which is subsequently pressed and dried, characterized in that dry fibers consisting essentially of ligno-cellulosic fibers of the type which when fully wetted have interfiber bonding capacity are introduced into the slurry of bond forming state fibers by being firstly slurried with water in a mixing vessel and being then pumped as a dry fiber/water slurry to the headbox of a papermaking machine along with said slurry of bond forming state fibers, whereby said dry fibers are interspersed with said*

*bond forming state fibers shortly before formation of the web and in such manner that the web incorporates initially dry fibers which entered the slurry in said introducing step and which retain a solids content of at least 50% by reason of having a short water contact time of less than 45 minutes while the web is formed and pressed and is creped by being passed over a yankee cylinder, the amount of said initially dry fibers being between 10% and 80% of the total fibers used to form the web, said bond forming state fibers being unrefined or refined only to a level such that the density of the creped web is between 0.06 and 0.20 g/cm³ measured by a caliper gauge at 42.2 g/cm² pressure with an anvil area of 6.45 cm².*

*23. A process according to claim 22 wherein said dry fibers are mixed with white water in said mixing vessel.*

*24. A process according to claim 22 wherein nits or lumps are removed from the dry fiber/water slurry before this is pumped to the vicinity of the headbox.*

*25. A process according to claim 22 wherein said dry fiber/water slurry is subjected to agitation before being pumped to the headbox.*

*26. A process according to claim 25 wherein said agitation is performed by a propeller type mixer.*

*27. A process according to claim 1 or claim 3 wherein said paper has a basis weight up to 40 g/m².*

*28. A process for the manufacture of a high bulk soft sanitary tissue paper processible in continuous roll form or a high bulk soft tissue layer of a multi-layered sanitary tissue paper processible in continuous roll form, said paper or layer being creped and said paper having a basis weight up to 60 g/cm², in which an aqueous slurry consisting essentially of ligno-cellulosic fibers and including such fibers in a paper-making bond forming state is dewatered in contact with a foraminous surface to form a web which is subsequently pressed and dried, characterized in that dry fibers consisting essentially of ligno-cellulosic fibers of the type which when fully wetted have interfiber bonding capacity are introduced into the slurry and interspersed with said bond forming state fibers shortly before formation of the web and in such manner that the web incorporates initially dry fibers which entered the slurry in said introducing step and which retain a solids content of at least 50% by reason of having a short water contact time of less than 45 minutes while the web is formed and pressed and is creped by being passed over a yankee cylinder, the amount of said initially dry fibers being between 10% and 80% of the total fibers used to form the web, said bond forming state fibers being unrefined or refined only to a level such that the density of the creped web is between 0.06 and 0.20 g/cm³ measured by a caliper gauge at 42.2 g/cm² pressure with an anvil area of 6.45 cm², and winding said tissue paper or multi-layered tissue paper onto a reel after the creping.*

*29. A process according to claim 28 wherein said paper has a basis weight of up to 40 g/m².*

* * * * *